US005813173A

United States Patent [19]

Way, Sr.

[11] Patent Number: 5,813,173

[45] Date of Patent: Sep. 29, 1998

[54] GUTTER PROTECTOR

[76] Inventor: Donald W. Way, Sr., 9225 Kings Canyon Dr., Charlotte, N.C. 28210

[21] Appl. No.: 845,697

[22] Filed: Apr. 25, 1997

Related U.S. Application Data

[63] Continuation of Ser. No. 580,133, Dec. 28, 1995, abandoned.

[51] Int. Cl.[6] ..... E04D 13/00

[52] U.S. Cl. ..... 52/12; 210/474

[58] Field of Search ..... 52/11, 12; 210/474

[56] References Cited

U.S. PATENT DOCUMENTS

| | | | |
|---|---|---|---|
| 3,950,951 | 4/1976 | Zukauskas . | |
| 4,551,956 | 11/1985 | Axford . | |
| 4,592,174 | 6/1986 | Hileman . | |
| 4,727,689 | 3/1988 | Bosler . | |
| 4,745,710 | 5/1988 | Davis . | |
| 4,765,101 | 8/1988 | Wolf . | |
| 4,769,957 | 9/1988 | Knowles . | |
| 4,876,827 | 10/1989 | Williams | 52/12 |
| 4,937,986 | 7/1990 | Way, Sr. et al. . | |
| 5,056,276 | 10/1991 | Nielson et al. | 52/12 |

*Primary Examiner*—Creighton Smith

*Attorney, Agent, or Firm*—Kennedy Covington Lobdell & Hickman, L.L.P.

[57] ABSTRACT

An improved gutter protector is disclosed of the type having an inner edge portion in contact with a row of shingles on a roof, a draining surface portion with a plurality of sequential, laterally extending sections, and an outer end portion extending from the draining surface portion for engagement with the outer edge of the gutter. At least one of the laterally extending sections is imperforate and at least one other of the laterally extending sections extends from the imperforate section at an outward inclination thereto and has a plurality of perforations for draining water therethrough. The perforations in the perforate section are lanced openings having inwardly offset surface portions obstructing entry and collection of debris in the openings.

7 Claims, 4 Drawing Sheets

GUTTER PROTECTOR

This is a continuation of application Ser. No. 08/580,133, filed Dec. 28, 1995, now abandoned.

BACKGROUND OF THE INVENTION

The present invention relates to a gutter protector and particularly to a gutter protector adapted for mounting over a gutter on a sloping shingle roof Roof gutters have been subjected to the problem of interference with proper drainage by accumulation of leaves and other debris for as long as they have been in use. Various attempts have been made to keep leaves and other debris from accumulating in the gutters with only limited success and often with some interference in effective draining of water into the gutters. For example, flat perforated gutter covers are disclosed in U.S. Pat. Nos. 3,436,878; 3,950,951; 4,727,689; 4,745,710; 4,765,101; and 4,769,957. All of these covers extend at a slight downward inclination over the top of the gutter in a manner which does prevent most leaves and debris from entering into the gutter, but do not effectively prevent some accumulation of leaves and debris on the cover blocking the passage of water into the gutter and thereby interfering with the purpose of the gutter itself.

In U.S. Pat. No. 4,592,174, a gutter protector is shown having an upstanding perforated back wall facing the roof and projecting above the adjacent level of the roof. This provides for effective drainage while preventing leaves and debris from entering the gutter, but only until there is an accumulation of leaves and debris against the wall sufficient to block drainage of water through the perforations of the wall and such accumulation remains to cause water to be retained at the back side of the gutter between the gutter and the building wall, causing further problems.

In U.S. Pat. No. 4,551,956, a compound gutter construction is disclosed in which a shallow gutter is mounted on top of an inner gutter with the shallow gutter preventing entry of leaves and debris into the inner gutter. While the shallow gutter does not accumulate leaves and debris to the same extent as a conventional deep gutter, there is leaf and debris accumulation to some extent and the shallow gutter is not as effective as a deep gutter in preventing rain water from falling off the edge of the roof during heavy rains.

In U.S. Pat. No. 4,937,986, a gutter protector is disclosed in which the perforations are all circular. While such circular perforations in the construction of that gutter protector do prevent entry of leaves and some debris into the gutter, they are susceptible to lodgment of debris such as pine needles endwise in the openings, where the pine needles enter the opening endwise and are stopped with entry ends abutting the bottom of the gutter. This has the result that the pine needles are stuck in place with lengths projecting upwardly out of the opening, which is not only unsightly but, importantly, can clog the openings, restraining intended flow of rain water through the openings into the gutter and results in catching and stopping leaves and other debris that are intended to be washed off the gutter protector by the flow of rain water over the gutter protector.

In contrast, the present invention provides a gutter protector that not only prevents entry and accumulation of leaves and other large debris while allowing rain water to flow through the openings into the gutter, but also prevents pine needles and other like debris from collecting in the openings and obstructing the passage of water therethrough and the flow of leaves and other debris off the gutter protector, and, while doing so, provides for entry of substantially all of the draining water into the gutter with the draining water effectively washing the debris off of the gutter protector out of interference with proper draining.

SUMMARY OF THE INVENTION

Briefly described, the present invention provides an improved gutter protector adapted for mounting on a sloping roof of the type having shingles arranged in horizontally extending overlapping rows. The gutter protector has an inner edge portion positionable in contact with a row of shingles, positioned such that the inner edge portion is either under a row of shingles or is in contact with the exposed surface of the shingles. A draining surface portion extends from the inner edge portion at an inclination with respect to the slope of the roof. The draining surface portion has a plurality of sequential, laterally extending sections, at least one of which is imperforate and at least one other of which extends from the imperforate section at an outward inclination with respect thereto and has a plurality of perforations for draining water therethrough. An outer end portion extends from the draining surface portion for engagement with the outer edge of the gutter. The perforations in the draining surface portion are preferably located for disposition over both the gutter and a portion of the shingles covered by the draining surface portion for draining of water directly into the gutter and also onto the shingles and therefrom into the gutter.

The perforations in the perforated section of the draining surface portion are in the form of lanced openings having inwardly offset surface portions that prevent the passage and collection of pine needles and the like, in addition to leaves and other debris, therethrough. Such lanced openings are substantially rectangular with the elongated side of the openings substantially parallel to the elongated extent of the gutter. The lanced openings are arranged in rows with the openings in alternate rows being staggered and overlapping with respect to the openings in adjacent rows, all rows being substantially parallel to the gutter. This results in no substantially perpendicular path from the inner edge portion to the gutter that does not intersect at least one of the lanced openings. Therefore, any water contacting the gutter protector and flowing towards the gutter will have its path interrupted by at least one of the lanced openings for draining therethrough.

Preferably, the lanced openings have a strip of material associated therewith that has been displaced from the draining surface portion to create the lanced opening. The displaced material remains connected to the draining surface portion at opposite ends of the lanced opening and displaced from the draining surface portion along the elongated opposing sides of the lanced opening. This results in two apertures between the displaced material and the draining surface portion through which the water drains.

With the foregoing construction, the improved gutter protector of the present invention provides efficient and effective draining of water into the gutter while preventing accumulation of debris, including pine needles and the like, in the gutter and in the openings of the gutter protector.

DETAILED DESCRIPTION OF THE PREFERRED EMBODIMENT

Figure 1:
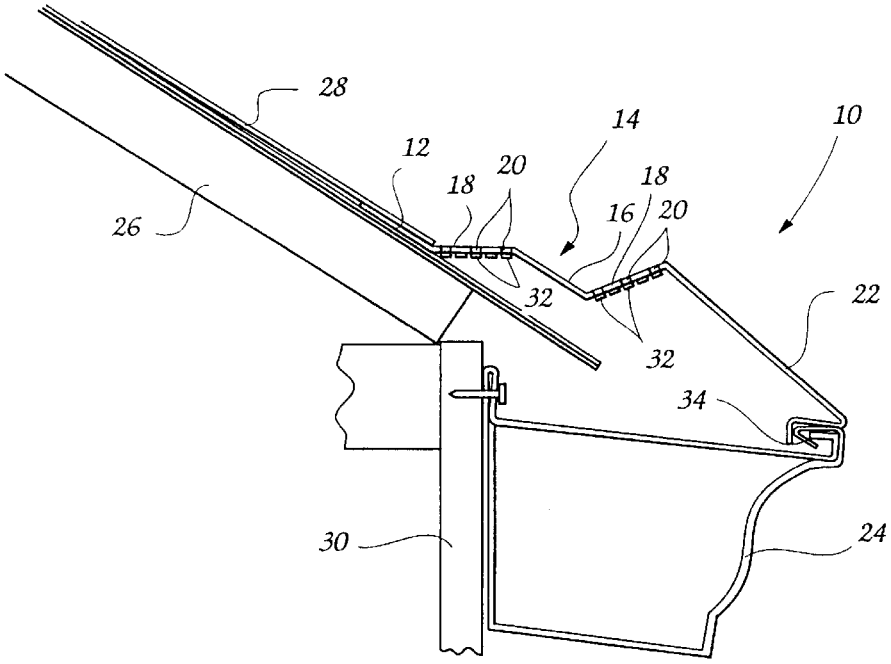
FIG. 1 is a vertical section of the outer portion of a roof showing a conventional gutter and a gutter protector according to the preferred embodiment of the present invention.

As is illustrated in the accompanying figures, the improved gutter protector 10 of the present invention comprises an inner edge portion 12, a draining surface portion 14 with a plurality of sequential, laterally extending sections, and an outer end portion 22 that engages the outer edge of the gutter 24. At least one of the sequential, laterally extending sections is an imperforate section 16, and at least one other of the sequential, laterally extending sections extends from imperforate section 16 at an outward inclination thereto and is a perforate section 18 with a plurality of perforations 20 for draining water and other liquid therethrough.

The preferred embodiment of the gutter protector 10 is illustrated mounted on a conventional roof 26 with shingles 28 attached thereto, the roof 26 being attached to a building structure 30. The shingles 28 of the roof 26 are arranged in horizontally extending rows and the inner edge portion 12 is positioned in contact with shingles 28. In the preferred embodiment, the inner edge portion 12 is positioned under a row of shingles 28, preferably the second such row from the edge of the roof 26. In another embodiment, the inner edge portion 12 is positioned on top of the row of shingles 28 and in contact therewith. By positioning the inner edge portion 12 in contact with the shingles 28, it is ensured that the water running down the shingles 28 encounters the inner edge portion 12 and flows thereover onto the draining surface portion 14.

It is not considered necessary to secure the inner edge portion 12 to the shingles 28 or the roof 26. Placement of the inner edge 12 under the edge of the shingles 28 is generally sufficient to secure the inner edge portion 12. If the inner edge portion 12 is placed on top of the shingles 28, the weight of inner edge portion 12, combined with the weight of the remaining portion of the gutter protector 10 and the attachment of the gutter protector 10 to the gutter 24, discussed below, is generally sufficient to ensure that the gutter protector 10 is immobile. It is contemplated that, if desired, the improved gutter protector 10 may be fastened to the shingles 28, roof 26, or building structure 30 if displacement of gutter protector 10 is noted. Such fastening may be by any suitable means of fastening, such as adhesives, nails, screws, or the like, and may be accomplished directly or by means of a bracket or the like.

Extending from the inner edge portion 12 is a multi-section draining surface portion 14. The draining surface portion 14 extends at an inclination with respect to the slope of the roof for extension at a spacing above the last row of shingles and above the gutter. This inclination may be varied as desired from an inclination that may be downward from the horizontal to an inclination upwardly from the horizontal. The inclination should be sufficient to provide a spacing from the roof to allow water to drain through the gutter protector 10 onto the roof 26 and into the gutter 24. The draining surface portion 14 should not be inclined substantially downwardly sufficient to result in a rapid flow of water over the draining surface portion 14 without draining the water through the perforations 20 formed therein. On the other hand, the inclination should not be sufficiently above horizontal to prevent washing of leaves and other debris outwardly off the draining surface portion 14, rather than accumulating on the surface and obstructing drainage. A suitable inclination can be selected based on experience and conditions.

The draining surface 14 is comprised of at least one imperforate section 16 and at least one perforate section 18, containing a plurality of perforations 20. In the preferred embodiment, a perforate section 18 extends from the inner edge portion 12, an imperforate section 16 extends from the first perforate section 18, and a second perforate section 18 extends from the imperforate section 16 to the outer end portion 22. Perforate sections 18 are comprised of a plurality of perforations 20 for the passage of water or other liquid therethrough.

Perforations 20 are lanced openings having inwardly offset surface portions 32. The offset surface portions 32 comprise a strip of material having opposed, elongated sides offset from perforate section 18 and the opposite ends of the offset surface portion 32 are connected to the perforated section 18. Stated another way, the offset surface portions 32 comprise a strip of material with opposite, elongated sides displaced from the perforate section 18 and still being attached to perforate section 18 where not offset therefrom. Thus, the offset surface portions 32 comprise shelf portions displaced interiorly of the perforations in the perforated section 18 in a substantially coextensive relation thereto, with a plurality of apertures between the displaced shelf portion of the offset surface portion 22 and the perforate section 18. Preferably, there are two apertures extending laterally between the ends of the shelf portion, which ends remain connected to the perforate section 18.

Such construction of the offset surface portions 32 allows for the passage of substantially all of the water or other liquid therethrough, while preventing the lodgment and collection of any debris, such as pine needles or the like, in the perforations 20. Thus, lodgment and collection of such debris as would otherwise enter the opening endwise and be stopped with the entry ends of the debris abutting the bottom of the gutter, resulting in the debris becoming stuck in the perforations such that lengths of the debris project upwardly out of the opening, is not possible. Therefore, the resultant tendency of such debris to dog the perforations 20 and restrict the flow of some of the water through the perforations 20 into the gutter 24, and the catching and stopping of leaves and other debris by the portions of the pine needles projecting upwardly out of the perforations 20, will not occur. The free flow of water through the perforations 20 and into the gutter 24 and the washing of leaves and other debris off of the gutter protector 10 will not be obstructed in any way.

In the preferred embodiment, the perforations 20 are substantially rectangular and are arranged such that the elongated sides of the rectangular perforations 20 extend substantially parallel to the elongated extent of the gutter 24. Thus, the water descending down the perforate section 18 encounters a greater extent of perforation 20 than if the perforations 20 were arranged such that the elongated sections thereof were perpendicular to the elongated extent of the gutter 24. This allows for substantially more water to pass through perforations 20.

In the preferred embodiment, the perforations 20 are arranged in rows on the perforate section 18, wherein these rows are substantially parallel to the elongated extent of the gutter 24. The perforations 20 in alternate rows are staggered and overlapping with respect to the perforations 20 in adjacent rows. This arrangement ensures that water passing over the perforate section 18 will encounter at least one perforation 20 in order to pass therethrough into the gutter 24 thereunder.

In the preferred embodiment, the offset surface portions 32 are displaced inwardly toward gutter 24 to minimize the congestion of the perforations 20 and to allow maximum transmittal of water therethrough.

The outer end portion 22 extends from the draining surface portion 14 to engage the edge of the gutter 24. The outer end portion 22 comprises a lip 34 for engagement with the outer edge of the gutter 24. The lip 34 is placed on the inside part of the outer edge of the gutter 24 and the entire gutter protector 10 is then flexed slightly to enable the inner edge portion 12 to slide under the shingles 28. Alternately, the inner edge portion 12 is laid upon the shingles 28, while the weight of the gutter protector 10 on the shingles 28, combined with the engagement of the lip 34 with the edge of the gutter 24, serves to immobilize the gutter protector 10. The outer end portion 22 is disposed at an angle from the horizontal sufficient to accommodate the angles chosen for the inner edge portion 12 and the draining surface portion 14 such that outer end portion 22 will engage the edge of the gutter 24. These angles will, of course, depend on the slope of the roof 26.

The angles of inclination of the perforate sections 18 and the imperforate section 16 are selected to facilitate the draining of water through the perforations 20 and the washing of leaves, pine needles, and other debris from the face of the gutter protector 10. Preferably, both perforate sections are inclined at a positive angle with respect to the horizontal to force the water draining from the shingles 28 to change direction. This helps to dislodge any debris that may have lodged against or atop the improved gutter protector 10. This also provides more direct passage of the water or other liquid into the perforations 20.

The inclination of imperforate section 16 is preferably at a negative angle relative to the horizontal to allow the downflow of water or other liquid thereover. However, such angle should not be great enough such that the speed of the water flowing over imperforate section 16 carries the water beyond perforate sections 18 without passage of the liquid through the perforations 20. It is preferably provided that there is an angle at each junction of the imperforate section 16 and the perforate sections 18 within the draining surface portion 14, and an angle provided at the junction of the inner edge portion 12 with the draining surface portion 14, and an angle provided at the junction of the draining surface portion 18 with the outer end portion 22. Such angles provide for a change in direction of the water or other liquid flowing over the gutter protector 10, which enhances the washing of leaves, pine needles, and other debris from the surface of the gutter protector 10.

The angle chosen for the outer end portion 22 is preferably such that, when the improved gutter protector 10 is mounted to protect a gutter 24 and is viewed from the ground, the perforations 20 in the perforate sections 18 are not visible. This preserves, or enhances, the aesthetics of the roof structure. Further, the improved gutter protector 10 may be provided in a variety of colors to match the surrounding shingles 28 and/or the color of the building structure 30.

Figure 2:
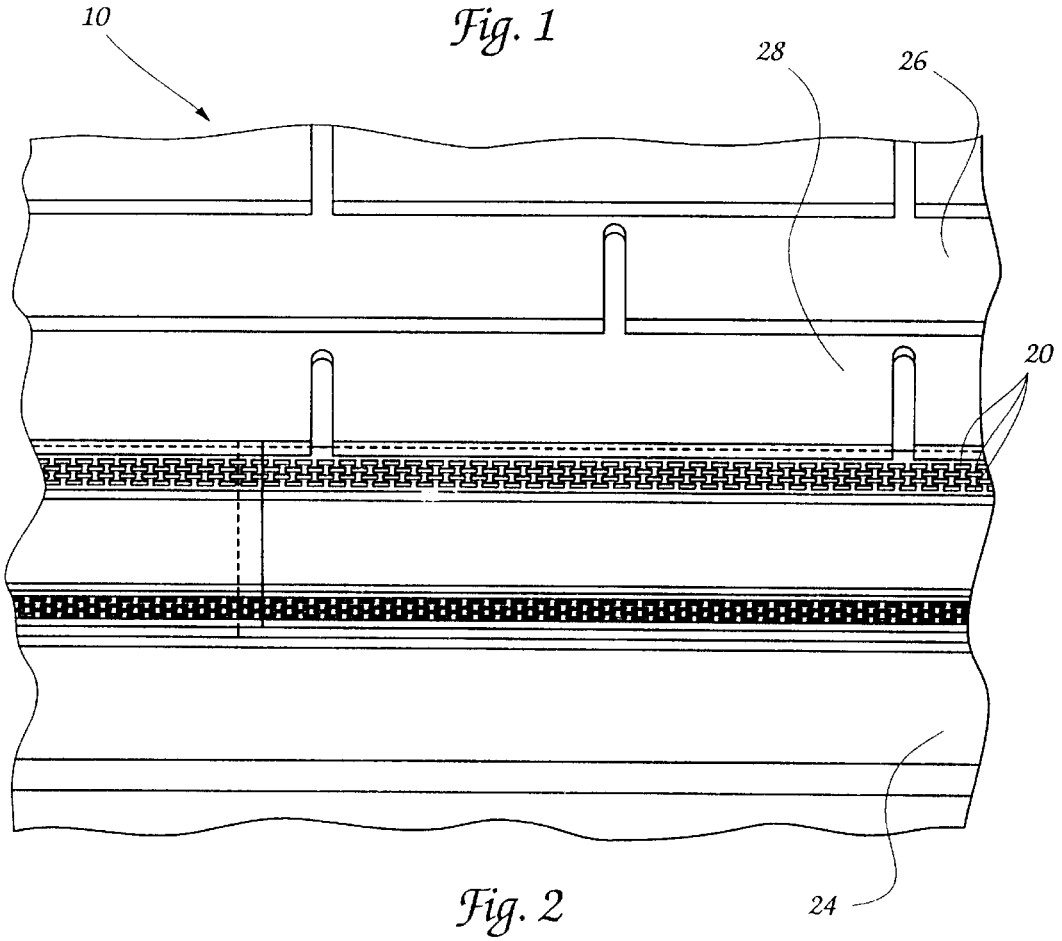
FIG. 2 is front elevation of the roof portion, gutter and gutter protector of FIG. 1.
Figure 3:
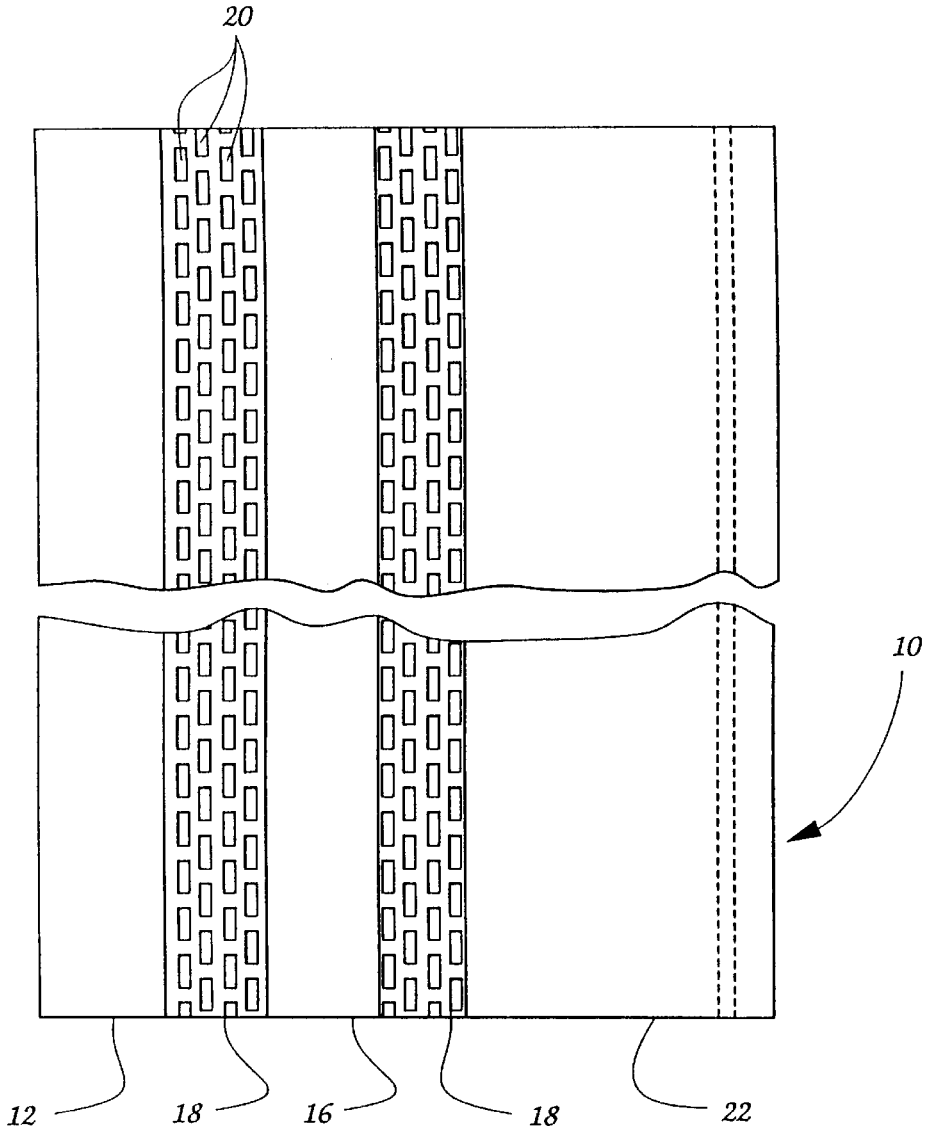
FIG. 3 is a plan view of the gutter protector of FIG. 1.
Figure 6:
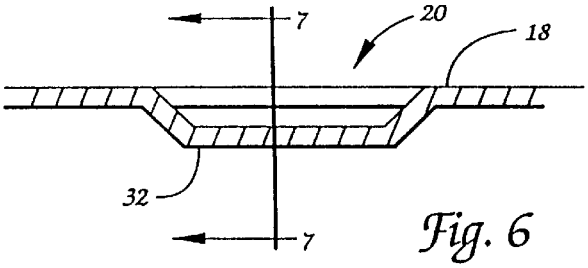
FIG. 6 is a cross-sectional view lengthwise through one of the indentations of the gutter protector of FIG 3.
Figure 7:
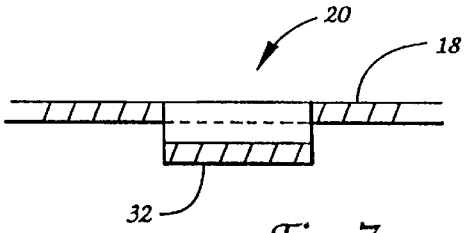
FIG. 7 is a widthwise cross-sectional view through one of the indentations of FIG. 3, taken along line 7–7 of FIG. 6.
Figure 4:
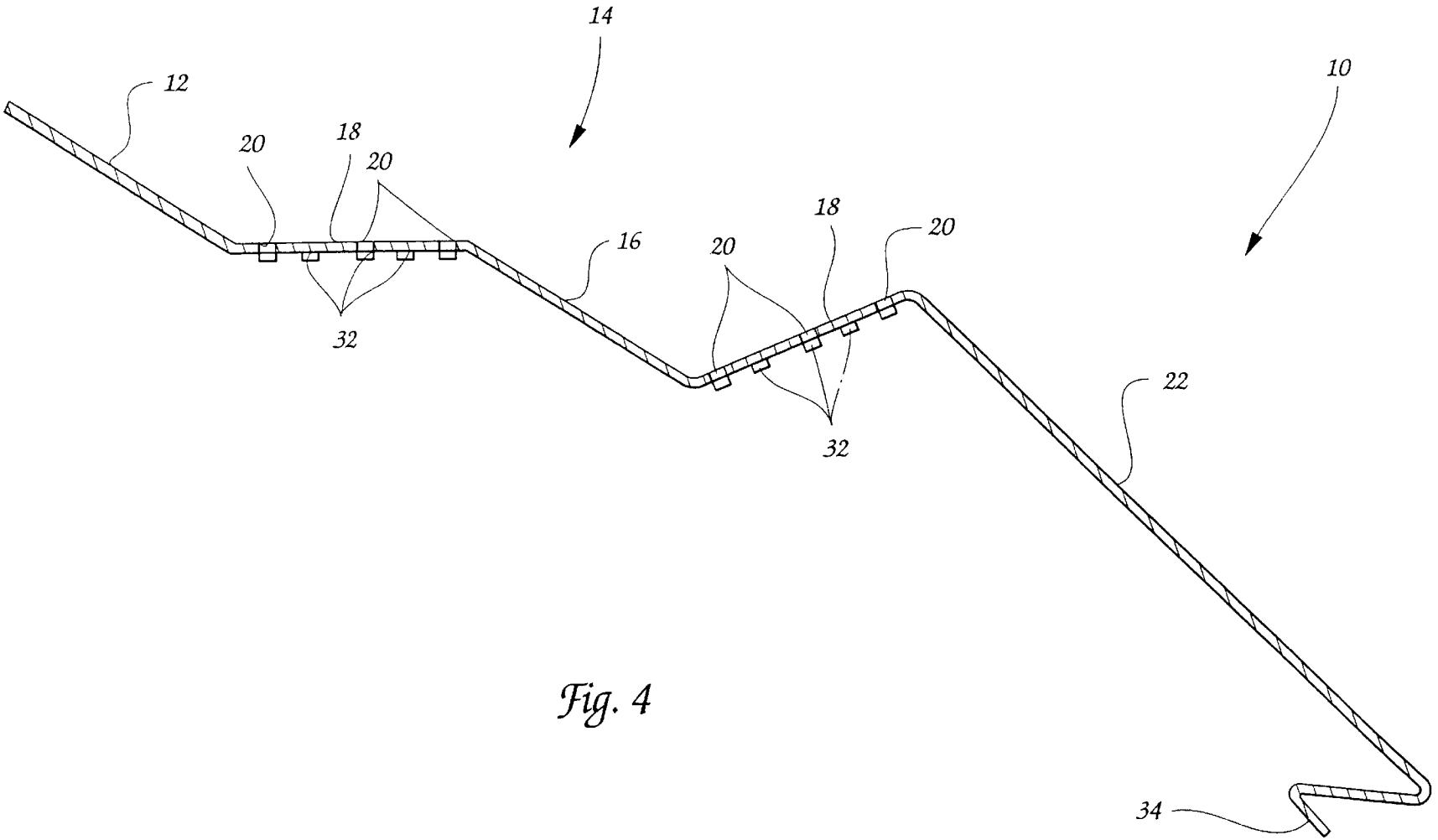
FIG. 4 is an enlarged vertical section of the gutter protector of FIG. 1
Figure 5:
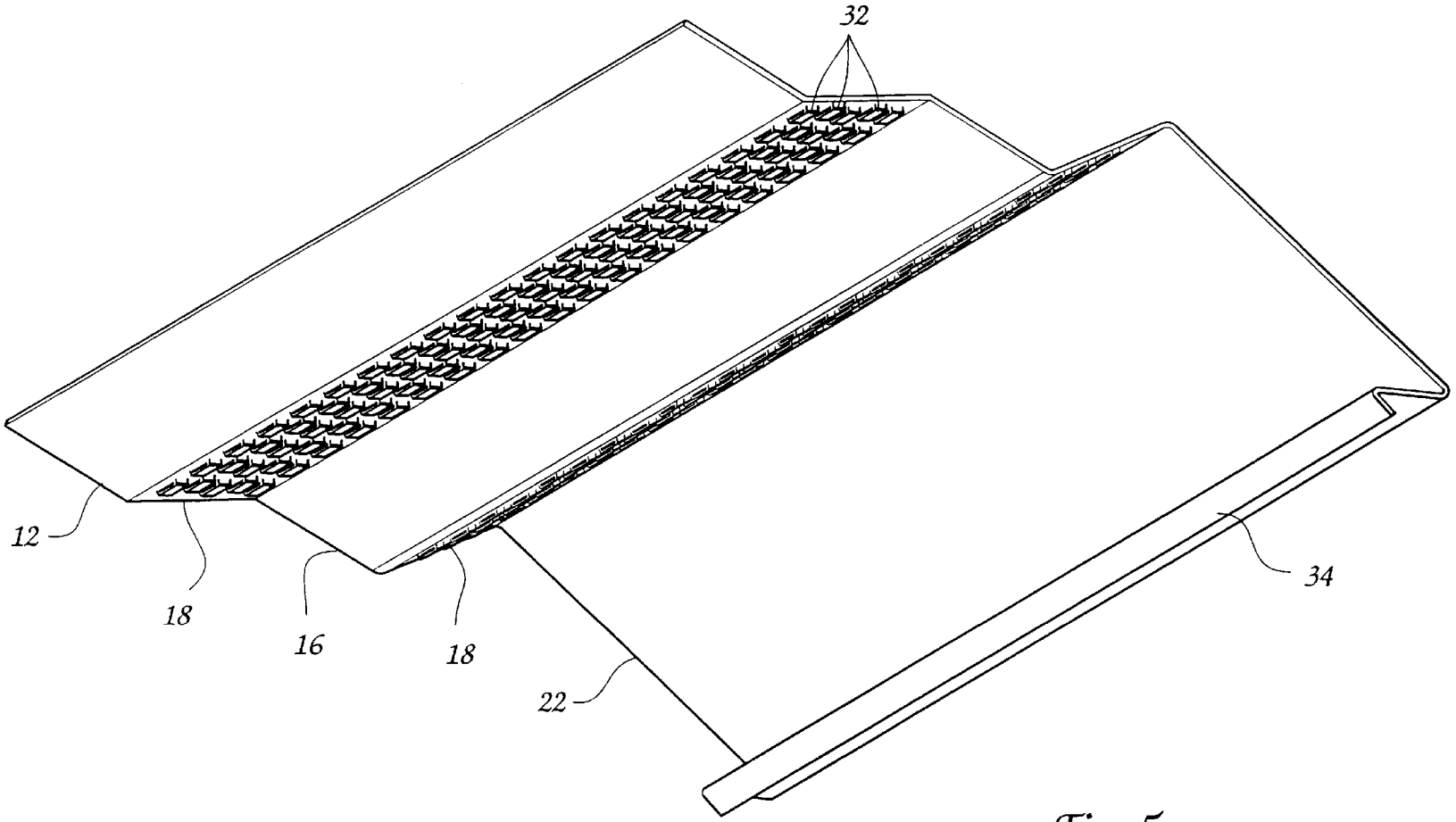
FIG. 5 is a bottom perspective view of the gutter protector of FIG. 1.

Preferably, the improved gutter protector 10 is constructed of pieces with discrete lengths. An appropriate number of pieces to accommodate the length of the gutter 24 to be protected may then be selected and installed. The selected lengths of the gutter protector 10 are overlapped, as illustrated in FIG. 2, to provide continuous and uninterrupted gutter protection.

In the preferred embodiment, the material of construction of the gutter protector 10 is sheet metal. In another embodiment, the material of construction of the gutter protector 10 is plastic. As will be obvious to one with ordinary skill in the art, a wide variety of materials is available for use in construction of the improved gutter protector 10.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An improved gutter protector of the type having an inner edge portion positionable in contact with a row of shingles on a roof, a draining surface portion with a plurality of sequential, laterally extending sections, at least one of said sections being imperforate and at least one other of said sections extending from said at least one imperforate section at an outward inclination with respect thereto and having a plurality of perforations for draining water therethrough, said draining surface portion extending from the inner edge portion, an outer end portion extending from the draining surface portion for engagement with an outer edge of a gutter having an elongated extent wherein the improvement comprises said perforations being formed by indented strips separated from said draining surface portion along side edges thereof and attached to said draining surface portion at ends thereof, thereby forming opposing openings extending in a generally perpendicular relationship with said draining surface portion to prevent elongate debris and debris larger than said openings from entering the gutter.

2. The gutter protector of claim 1, wherein said perforations are substantially rectangular.

3. The gutter protector of claim 2, wherein said perforations have elongated sides extending substantially parallel to the elongated extent of the gutter.

4. The gutter protector of claim 3, wherein said perforations are arranged in rows, with the perforations in alternate rows being staggered and overlapping with respect to the perforations in adjacent rows, said rows being substantially parallel to the elongated extent of the gutter.

5. The gutter protector of claim 1, wherein said perforations are arranged in rows, with said perforations in alternate rows being staggered and overlapping with respect to said perforations in adjacent rows, said rows being substantially parallel to the elongated extent of the gutter.

6. The gutter protector of claim 1, wherein the gutter protector is constructed from plastic.

7. The gutter protector of claim 1, wherein the gutter protector is constructed from sheet metal.

* * * * *